US007833060B2

(12) United States Patent
Tsai

(10) Patent No.: US 7,833,060 B2
(45) Date of Patent: Nov. 16, 2010

(54) LED BULB ASSEMBLY

(75) Inventor: Kenneth Tsai, Dong Guan (CN)

(73) Assignee: Digicrown International Ltd., Dong Guan (CN)

( * ) Notice: Subject to any disclaimer, the term of this patent is extended or adjusted under 35 U.S.C. 154(b) by 61 days.

(21) Appl. No.: 12/007,575

(22) Filed: Jan. 11, 2008

(65) Prior Publication Data

US 2008/0200074 A1 Aug. 21, 2008

(51) Int. Cl.
*H01R 33/09* (2006.01)

(52) U.S. Cl. ..... 439/619

(58) Field of Classification Search ..... 439/619, 439/699.2, 617, 618; 362/653, 654; 313/381.01, 313/381.12

See application file for complete search history.

(56) References Cited

U.S. PATENT DOCUMENTS 6,102,551 A * 8/2000 Hsu ..... 362/654
7,217,005 B2 * 5/2007 Lin ..... 362/249.02

* cited by examiner

*Primary Examiner*—Phuong K Dinh
(74) *Attorney, Agent, or Firm*—Rosenberg, Klein & Lee

(57) ABSTRACT

The LED bulb assembly includes a connector, an LED including two conductive wires, and means for attaching the LED to the connector and preventing the two conductive wires from contacting each other. The means for attaching the LED to the connector and preventing the two conductive wires from contacting each other may include a plate in the connector, and each of the two conductive wires extends along different sides of the plate. Alternatively, the means for attaching the LED to the connector and preventing the two conductive wires from contacting each other may include each of the conductive wires having a thickness such that the two conductive wires supports the LED while maintaining a gap between the two conductive wires.

5 Claims, 7 Drawing Sheets

LED BULB ASSEMBLY

CROSS REFERENCE TO RELATED APPLICATIONS

This application claims the benefit of Taiwanese Patent Application No. 96201920, filed Feb. 1, 2007, and is herein incorporated by reference in its entirety.

BACKGROUND OF THE INVENTION

1. Field of the Invention

The present invention is directed generally to light-emitting diode (LED) bulbs and more particularly to LED bulbs including flexible conductive wires.

2. Description of Related Art

It is known to use LEDs to replace conventional miniature bulbs in bulb assemblies because of the ease and cost of manufacturing LEDs. As seen in FIG. 1, a conventional LED 10 consists of a package 12 and two corresponding electrodes 14. Each of the electrodes 14 has a generally rectangular body, which resists bending and is easily broken. Consequently, it is easily destroyed when being assembled into a bulb assembly. Moreover, the conventional LED cannot be reused after assembly.

BRIEF SUMMARY OF THE INVENTION

It is therefore a primary object of the invention to provide an LED bulb assembly, which includes a pair of bendable conductive wires to function as the electrodes. By using conductive wires, an LED bulb assembly can experience repeated bending without fatiguing as quickly as convention LEDs. Moreover, because of the flexibility of the conductive wires, the LED can be reused if removed from the LED bulb assembly.

According to principles of this invention, an LED bulb assembly is provided. The LED bulb assembly includes a connector, an LED including two conductive wires, and means for attaching the LED to the connector and preventing the two conductive wires from contacting each other.

In another aspect, the LED bulb assembly may include a holder and two contact pins supported by the holder, wherein the holder receives the connector and each of the two conductive wires contacts different contact pins of the two contact pins.

In still another aspect, the LED bulb assembly may include an LED chip on the LED and a shell connected to the connector, where the shell covers the LED chip.

In yet another aspect, each of the conductive wires may include an end opposite the LED being bent towards the LED to contact the respective contact pin.

In another aspect, the means for attaching the LED to the connector and preventing the two conductive wires from contacting each other includes a plate in the connector, where each of the two conductive wires extends along different sides of the plate. The plate may include a seat portion that supports the LED chip.

In a different aspect, the means for attaching the LED to the connector and preventing the two conductive wires from contacting each other may include each of the conductive wires having a thickness such that the two conductive wires supports the LED while maintaining a gap between the two conductive wires.

In still another aspect, the LED may transmit one of a red, blue, green, and white light.

According to other principles of the invention, an LED bulb assembly is provided. The LED bulb assembly includes a connector having a plate therein and an LED having a pair of bendable conductive wires, each of the conductive wires being inserted into the connector along different sides of the plate, and the plate separating the conductive wires from one another.

Other aspects of the LED bulb assembly are similar to those described above.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE INVENTION

Figure 1:
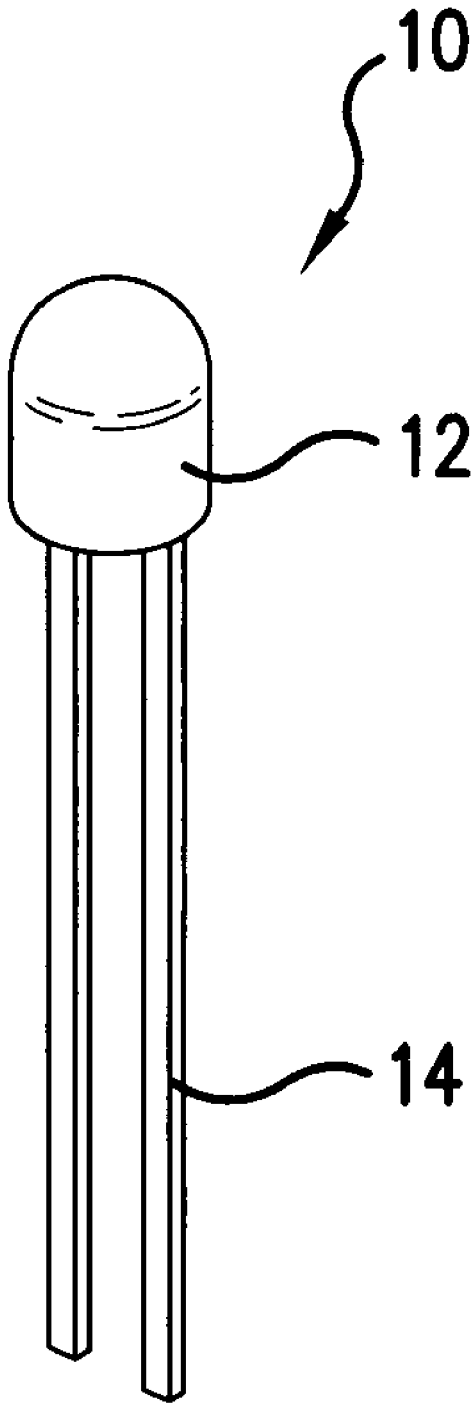
FIG. 1 is an exploded perspective view showing a conventional LED.

According to a first exemplary embodiment of the present invention, as seen in FIGS. 2-5, an LED bulb assembly includes a holder 20, a connector 30, a shell 40, and an LED 50. The LED bulb assembly may be part of a string assembly (not shown) to be used for decorative or ornamental lighting, such as, for example, Christmas lighting or other holiday lighting. In addition, the LED bulb assembly can be used as a single light source as well as part of a plurality of light sources.

According to the first exemplary embodiment, LED 50 includes a pair of bendable conductive wires 51 that transmit electricity to the LED chip 52. The wires 51 are thinner than conventional electrodes and consequently can be repeatedly bent without breaking. As a result, the LED 50 can be repeatedly inserted/removed from the LED bulb assembly without damage.

Figure 2:
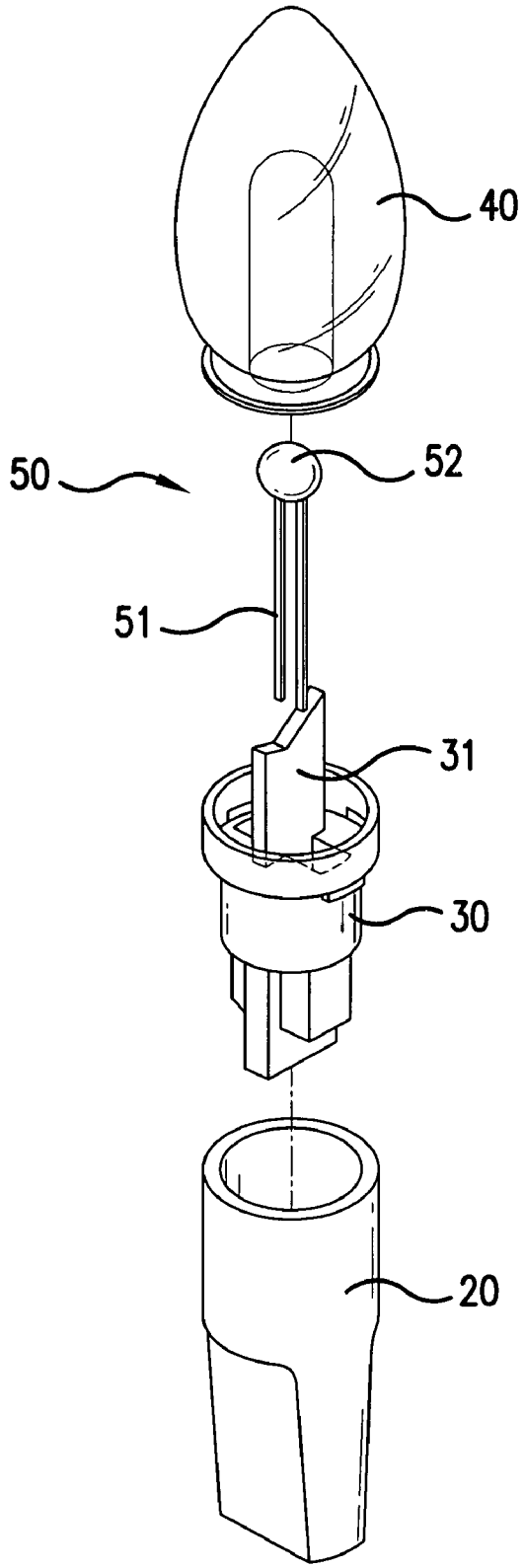
FIG. 2 is an exploded perspective view showing an LED bulb assembly according to a first embodiment of the present invention.
Figure 5:
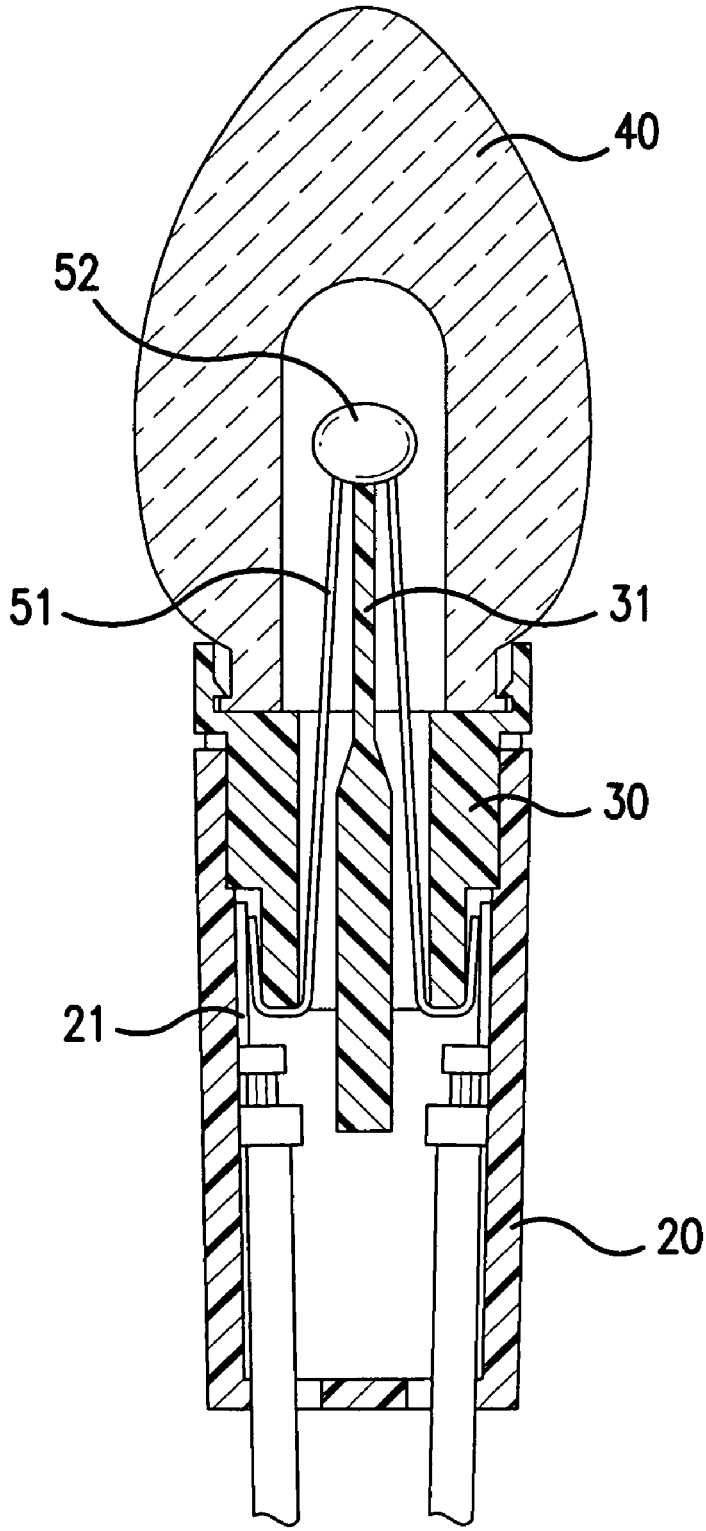
FIG. 5 is a cross-sectional plan view of the LED bulb assembly of FIG. 4.

As best seen in FIG. 2, the connector 30 may be provided with a plate 31. The plate 31 may take the form of a thin plate that extends substantially along the axis of the connector 30. The purpose of the plate 31 is to separate the conductive wires 51 to avoid a short circuit. In addition, the thin plate 31 may also include a seat portion 32 to support the LED chip 52 inside the LED bulb assembly. As seen in FIG. 5, the plate 31 may be thinner at the top than at the bottom to allow the plate to adequately support the LED 50 while being securely connected within connector 30. While the connector 30 and plate 31 have been shown with a specific configuration, it is understood that other configurations can be provided so long as the plate 31 provides adequate spacing between the conductive wires 51. In addition, the plate 31 and connector 30 may be made of the same or different materials.

As seen in FIG. 5, the holder 20 includes a plurality of contact pins 21 that are arranged so that the conductive wires 51 of the LED are connected to electrical wires of a light string (not shown). As best seen in FIG. 5, each conductive wire 51 has its outer end bent upward to contact a respective pin 21 in the holder 20 when the connector 30 is inserted in the holder 20.

The shell 40 is placed on the connector 30 using conventional techniques and covers the LED 50 positioned on top of the plate 31. The shell 40 may be a transparent material or it may have a specific color. If the shell is transparent, the LED may be red, green, blue, or white depending on the desired color of the light to be transmitted. As a result, selecting the appropriate shell material and type of LED may provide many different color combinations.

Figure 3:
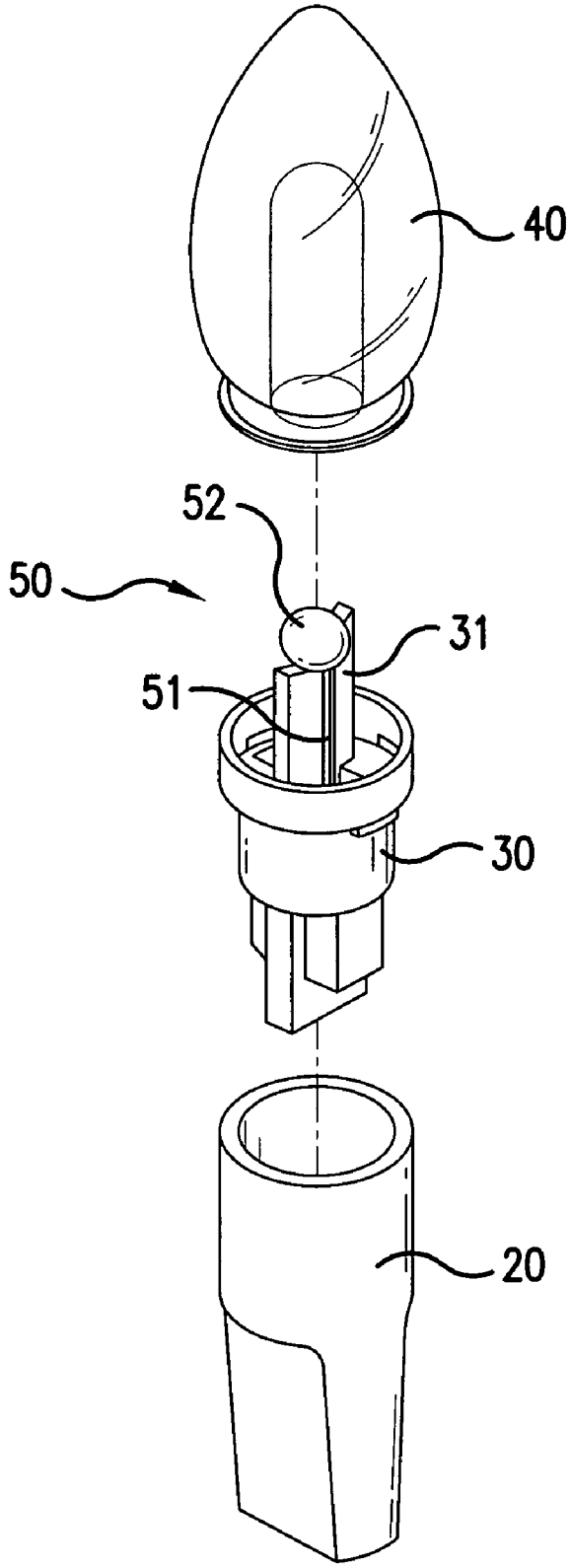
FIG. 3 is a partial assembled perspective view of the LED bulb assembly of FIG. 2.
Figure 4:
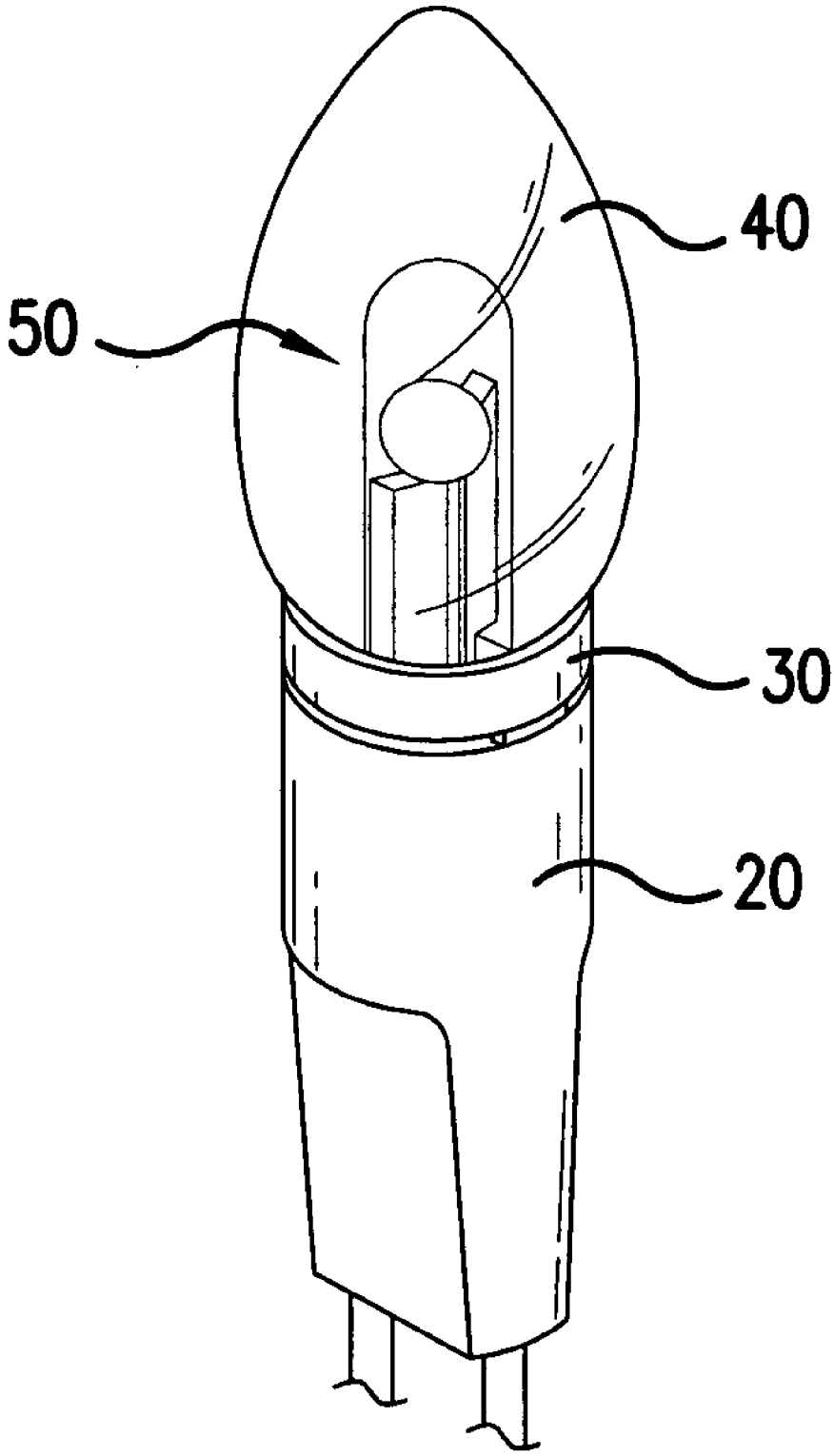
FIG. 4 is a completed assembled perspective view of the LED bulb assembly FIG. 2.

Having described the LED bulb assembly, the method of assembling the LED bulb assembly will be described with reference to FIGS. 2-4. First, connector 30 and plate 31 are provided. Plate 31 may be formed integral with the connector 30 or separately attached to the connector 30. The LED 50 is attached to the connector 30 by inserting the conductive wires 51 through the connector 30 and along different sides of the plate 31. The ends of the conductive wires 51 may then be bent around the exterior surface of the connector 30 to secure the LED 50 to the connector 30.

Next, the connector 30 and LED 50 are inserted into the holder 20 such that the connector wires 51 contact the contacting pins 21 (shown in FIG. 5) to provide an electrical connection between the contacting pins 21 and the LED 50.

Finally, the shell 40 is inserted over the LED 50 and attached to the connector 30 using conventional techniques. The shell covers at least the LED chip 52. Alternatively, the shell 40 may be attached to the connector 30 prior to the connector 30 being inserted into the holder 20. In this alternative arrangement, the combination of the shell 40, LED 50, and connector 30 may be formed as a sub assembly of the LED light assembly and provided independent of the holder 20.

Accordingly, the LED bulb assembly of the present invention can effectively contact the contact pins 21 of the electrical wires of the light string and the two conductive wires 51 are adequately separated from each other to prevent a short circuit. Further, the conductive wires 51 are more bendable than conventional electrodes and may more easily be assembled into an LED bulb assembly resulting in a structure that is stable and is bendable without damage.

Figure 6:
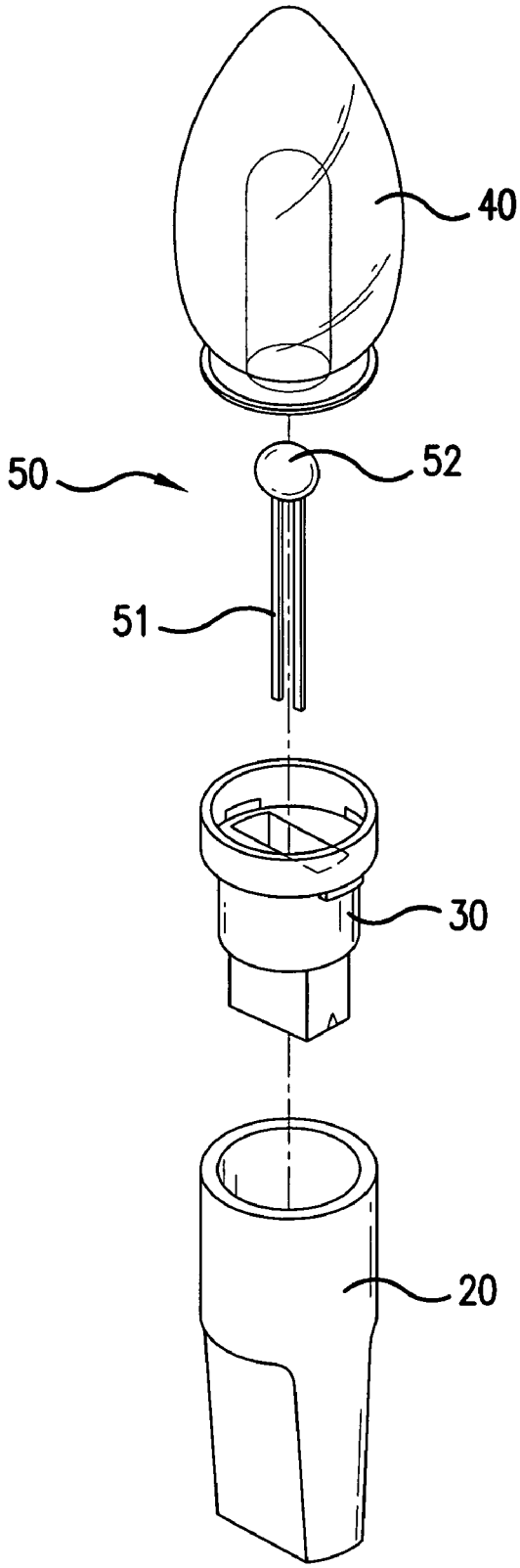
FIG. 6 is an exploded perspective of an LED bulb assembly according to a second exemplary embodiment of the present invention.
Figure 7:
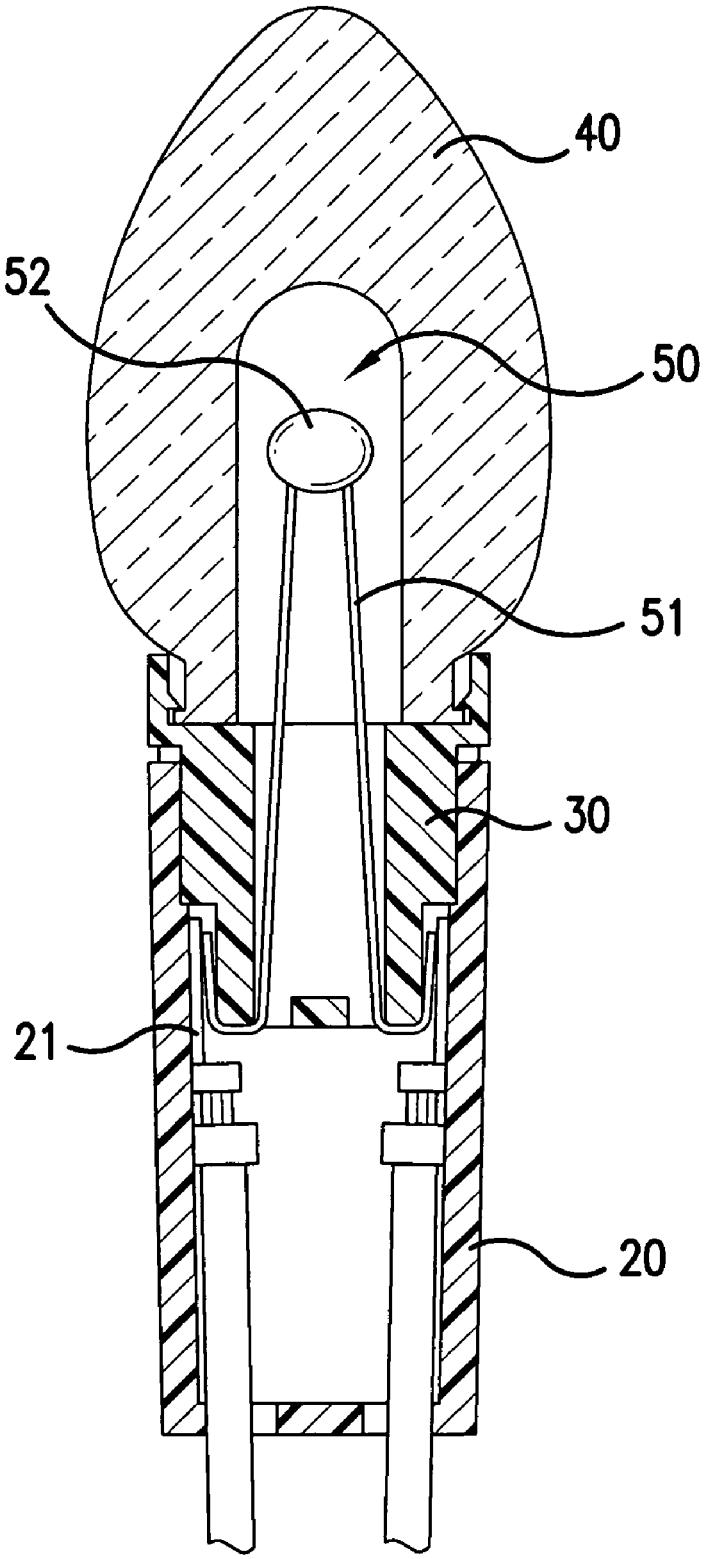
FIG. 7 is an assembled cross-sectional plan view of the LED bulb assembly of FIG. 6.

While the first exemplary embodiment of the present invention has been described with a plate 31, it is possible to eliminate the plate 31 as seen in the second exemplary embodiment shown in FIGS. 6 and 7. In the second exemplary embodiment, the conductive wires 51 may be strong enough to support the LED 50 without the use of a plate. For example, the conductive wires may be slightly thicker than those used in the first exemplary embodiment. In this arrangement, the thickness of the conductive wires must be selected such that they do not fatigue easily yet are strong enough to maintain the spacing between the conductive wires to avoid short circuits. In all other aspects, the second exemplary embodiment is the same as that described above for the first exemplary embodiment.

The invention thus being described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. An LED bulb assembly comprising:

a connector having a plate therein;

an LED having a pair of bendable conductive wires, each of the conductive wires being inserted into the connector along different sides of the plate, the plate separating the conductive wires from one another; and an LED chip on the LED, wherein the plate includes a seat portion supporting the LED chip.

2. The LED bulb assembly according to claim 1, further comprising a holder and two contact pins supported by the holder, wherein the holder receives the connector and each of the two conductive wires contacts different contact pins of the two contact pins.

3. The LED bulb assembly according to claim 1, further comprising a shell connected to the connector, the shell covering the LED chip.

4. The LED bulb assembly according to claim 1, wherein each of the conductive wires includes an end opposite the LED being bent towards the LED to contact the respective contact pin.

5. The LED bulb assembly according to claim 1, wherein the LED transmits one of a red, blue, green, and white light.

* * * * *